US005290124A

United States Patent [19]

Pavlescak

[11] Patent Number: 5,290,124

[45] Date of Patent: Mar. 1, 1994

[54] BOAT STAND

[75] Inventor: James J. Pavlescak, Middleberg Heights, Ohio

[73] Assignee: Waco International Corporation, Cleveland, Ohio

[21] Appl. No.: 908,395

[22] Filed: Jul. 6, 1992

[51] Int. Cl.[5] ..... B63C 1/08; B63C 15/00

[52] U.S. Cl. ..... 405/3; 405/7

[58] Field of Search ..... 405/7, 1, 3-6, 405/2; 114/44-48

[56] References Cited

U.S. PATENT DOCUMENTS 1,397,487 11/1921 Leighton .
3,139,277 6/1964 Mears ..... 405/7 X
4,449,846 5/1984 Price ..... 405/7
4,468,150 8/1984 Price ..... 405/7
4,756,642 7/1988 Quinn et al. ..... 405/7
4,759,660 7/1988 Corbett .
4,773,346 9/1988 Blanding et al. .
4,944,633 7/1990 Robb ..... 405/7 X

*Primary Examiner*—Dennis L. Taylor
*Attorney, Agent, or Firm*—Pravel, Hweitt, Kimball & Krieger

[57] ABSTRACT

Boat stand assemblies for dry dock maintenance or storage of boats with and without keels including two or more rigid frames of adjustable width each including a pair of struts of adjustable height, the frames being connectable by cross braces to provide a complete stand and further including a keel stand assembly similarly constructed of height and spacing adjustable struts.

21 Claims, 5 Drawing Sheets

BOAT STAND

FIELD OF THE INVENTION

The present invention relates generally to shoring type structures for supporting boats in dry dock for maintenance and storage, and in particular to a boat stand which is adaptable to a wide variety of hull sizes and configurations and is easy to assemble, while providing maximum access to the hull and keel for dry dock maintenance.

BACKGROUND OF THE INVENTION

Various types of shoring structures have been devised and used for supporting boat hulls for dry dock storage and maintenance. Because of the wide variety of hull shapes, keels and boat sizes, these structures have generally been custom constructed at the maintenance or storage site for particular boats using basic timber elements, tie rods, and jack stands. Examples of such custom constructed stands are found in U.S. Pat. No. 3,139,277 to Mears and U.S. Pat. No. 4,756,642 to Quinn, and U.S. Pat. No. 4,759,660 to Corbett. These types of constructions generally require that individual jack stands be place about the boat hull and individually adjusted, with the addition of some cross supports between jack stands.

U.S. Pat. No. 4,468,150 to Price and U.S. Pat. No. 4,944,633 to Robb illustrate attempts to provide cradle type supports which can accommodate boats of varying sizes by providing means for inwardly tilting jack stands mounted on a base structure. These types of cradles require tensioning tie rods or other types of supports with multiple adjustments and fastenings. In addition, cradle type boat stands rely on skewing the jack stands to accommodate hulls of varying widths and lengths. Skewed supports, however, are inherently less stable than vertical supports. It would therefore be desirable to have a boat stand which is easily assembled, uses the more stable vertical supports, and yet can accommodate a wide range of boat hull and keel sizes and the need for access at a variety of locations along the hull and keel.

SUMMARY OF THE INVENTION

The boat stand of the present invention provides a system of rigid weight bearing frames for supporting a boat hull fore and aft, connected by cross braces to provide a complete frame structure for supporting a hull for maintenance and/or storage. Each frame generally includes a pair of struts connected in fixed spaced apart relationship by at least one transverse brace with each strut mounting a tiltable pad. The transverse brace may be either solid or of a split construction for adjustment of the frame width so that the pads can be suitably spaced apart for a particular hull width, but is constructed to maintain the struts in substantially vertical relationship relative to the ground for maximum side to side stability. The transverse brace can be further provided with an additional strut for support beneath the centerline of a keelless boat. To accommodate keeled boats which require particularly tall struts, one or more additional transverse brace members may be included to provide suitable structural rigidity to the fore and aft frame members. In addition, the invention includes a keel stand which provides support about a heavy keel.

DETAILED DESCRIPTION OF PREFERRED EMBODIMENTS

Overview

Figure 1:
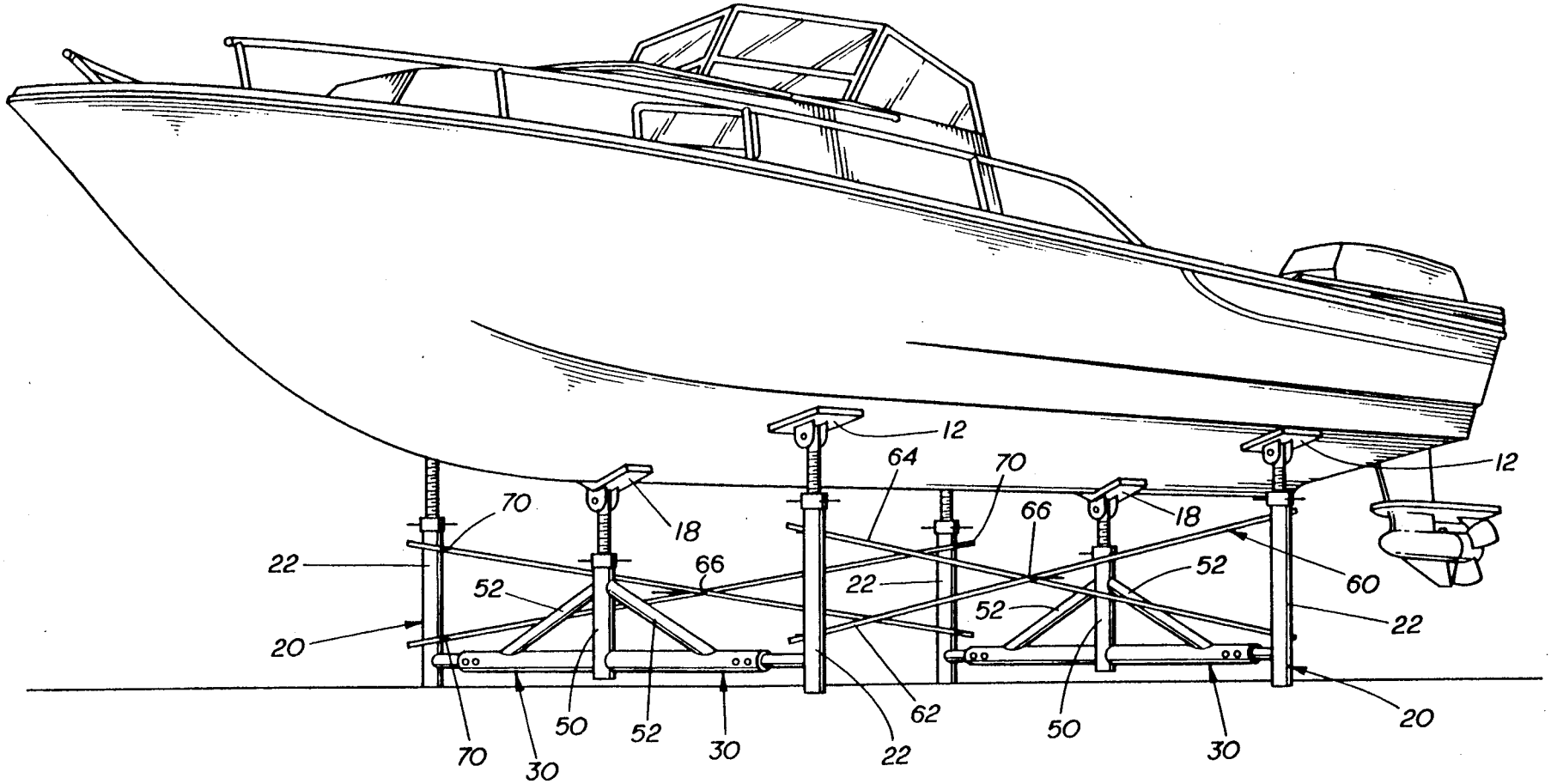
FIG. 1 is a perspective view showing one embodiment of a boat stand system in accordance with the invention adapted for supporting a keelless boat.
Figure 2:
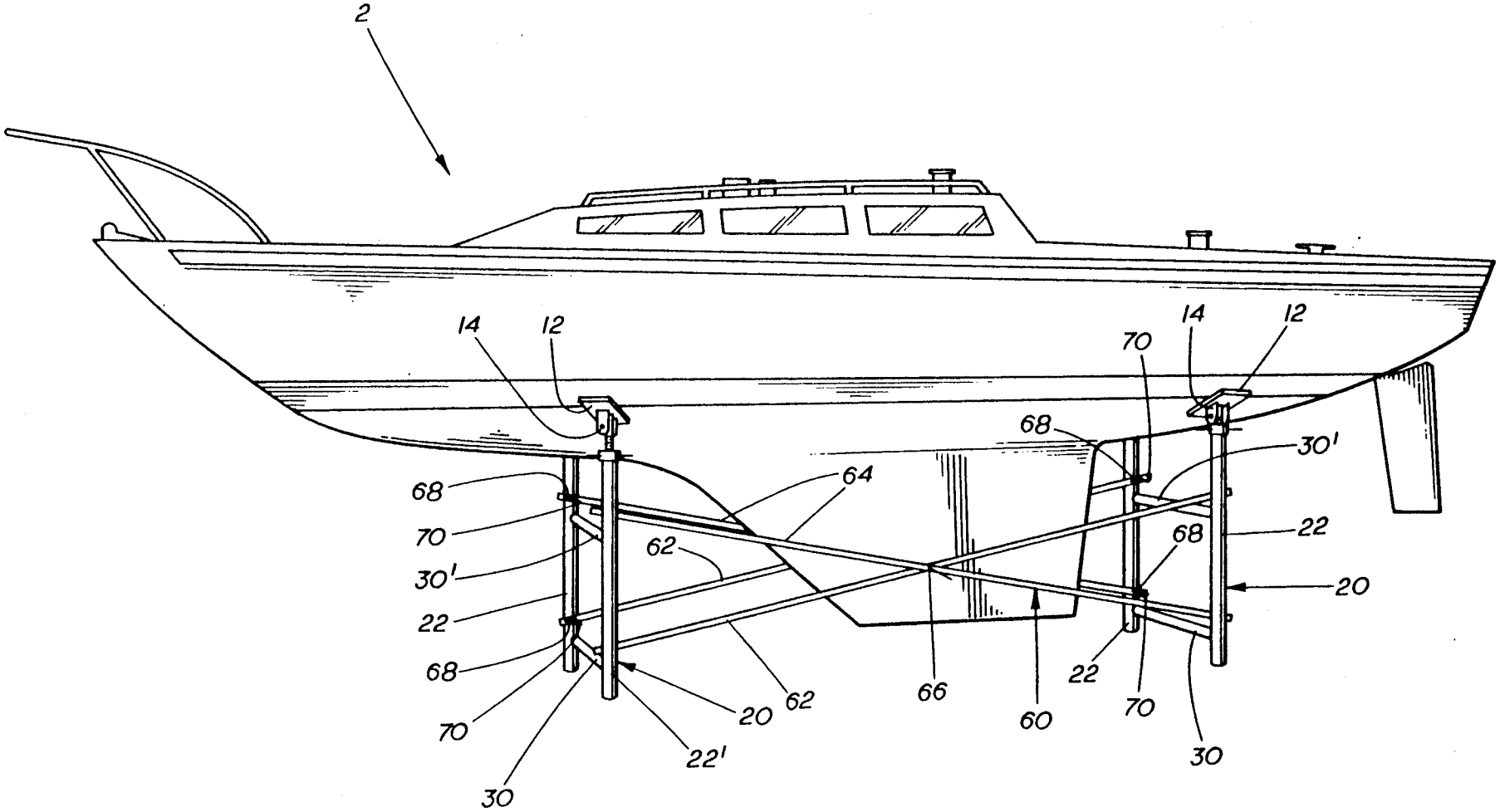
FIG. 2 is a perspective view of an embodiment of the invention for supporting a keeled boat.

As illustrated in the Drawing, the boat stand of the present invention generally includes identical fore and aft frame members connected and stabilized into a complete boat stand system by way of fixed cross braces to provide a complete shoring system. The embodiment shown in FIG. 1 is most suited for supporting a keelless boat, with the embodiment of FIG. 2 most suited for a keeled boat. The common features of these embodiments are the four corner struts 22, illustrated in detail in FIG. 3, the interconnecting adjustable transverse braces 30 illustrated in detail in FIGS. 4 and 5, and the cross braces 60 (FIGS. 1 and 2).

Figure 5:
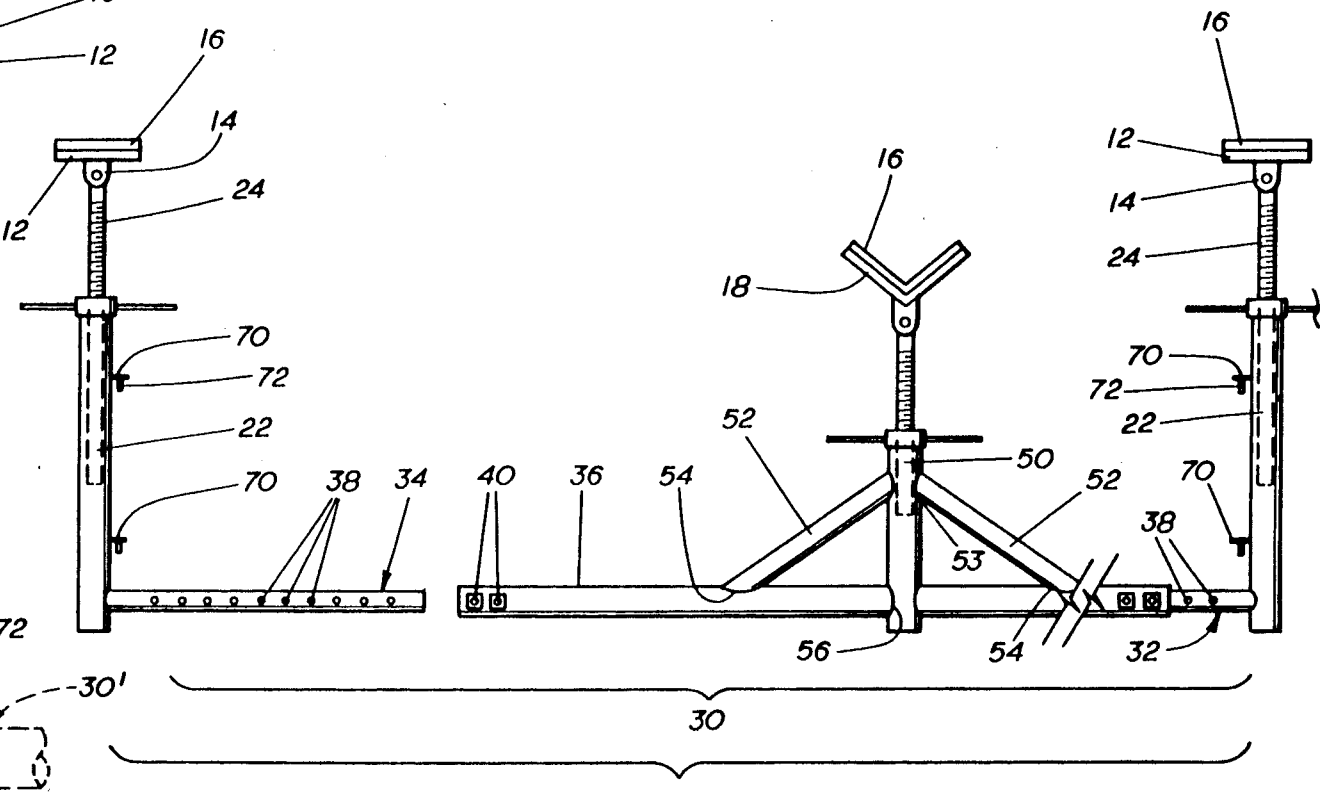
FIG. 5 is a partially exploded view illustrating an adjustable frame width feature particularly suitable for the keelless boat stand embodiment of FIG. 1.

The keelless boat embodiment shown in FIGS. 1 and 5, includes an optional intermediate strut 50 fore and aft for supporting a boat along its centerline as well as the outer edges of its hull sides. In this embodiment, the intermediate strut So is mounted on the transverse strut brace 30 and provided with additional supporting arms 52.

In the keeled boat embodiment of FIG. 5, two transverse braces 30 and 30' space and support the corner struts 22. For additional keel support and ample access to the keel for repairs, the invention further includes a keel stand including a keel frame illustrated in FIG. 6 which can be assembled into a complete keel stand using cross braces 60 identical to those illustrated in combination with the fore and aft frames of the invention, to complete the keel shoring assembly.

DETAILED DESCRIPTION

Corner Struts

Figure 3:
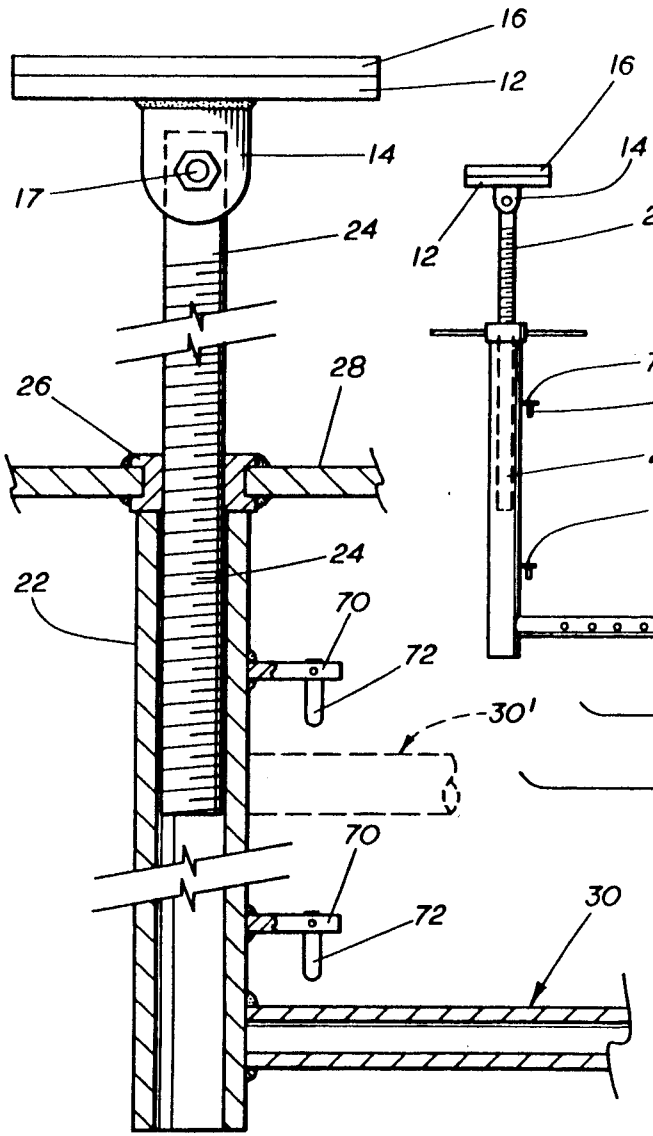
FIG. 3 is detailed cross sectional view of the extendable strut feature of the boat stand of the present invention.

With specific reference to FIG. 3 of the Drawing, a typical corner strut 22 is shown mounting a pad 12, by way of an axially or universally pivoting connector 14. The pad 12 may be provided with any suitable cushioning layer 16, such as wood, foam rubber, carpet or the like to prevent denting or abrasion to the hull.

The height of pad 12 may be provided with any suitable height adjusting mechanism. As shown in FIG. 3, the height adjusting mechanism for the pad 12 includes a screw jack arrangement including threaded shaft 24 for engagement with threaded fitting 26, which is adjustable by way of hand crank 28. The pad 12 is mounted to the shaft 24 by way of the connector 14 provided with nut 17 for securing the pad at any suitable angle.

Transverse Strut Braces

The corner struts 22 are supported in their vertical position by way of one or more transverse braces 30. In the preferred embodiment, the braces 30 are secured to the struts 22 by welding to provide suitable structural rigidity to the fore and aft frames.

Figure 4:
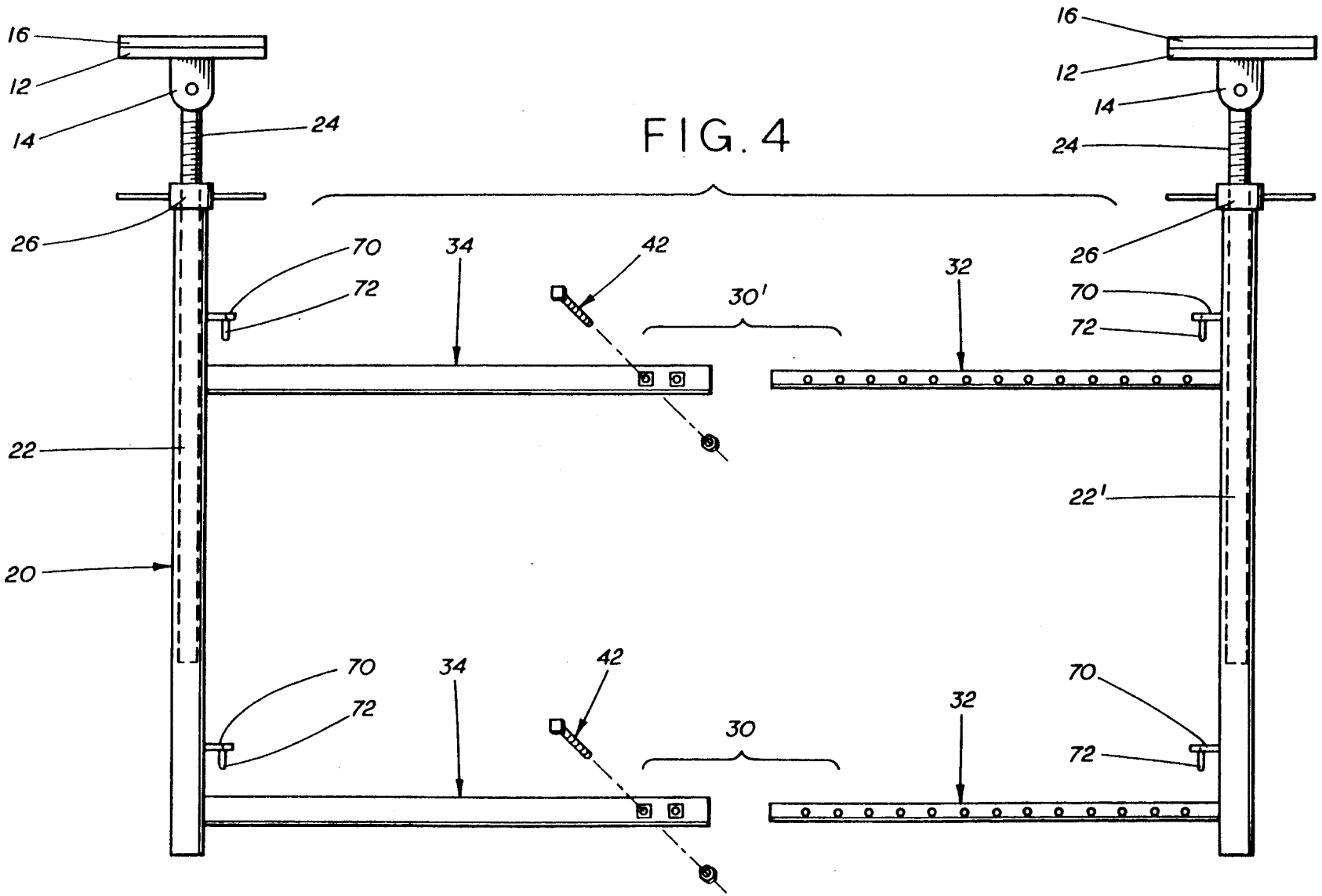
FIG. 4 is a partially exploded view illustrating an embodiment of the adjustable frame width feature of the invention particularly suited for the keeled boat stand of FIG. 2.
Figure 6:
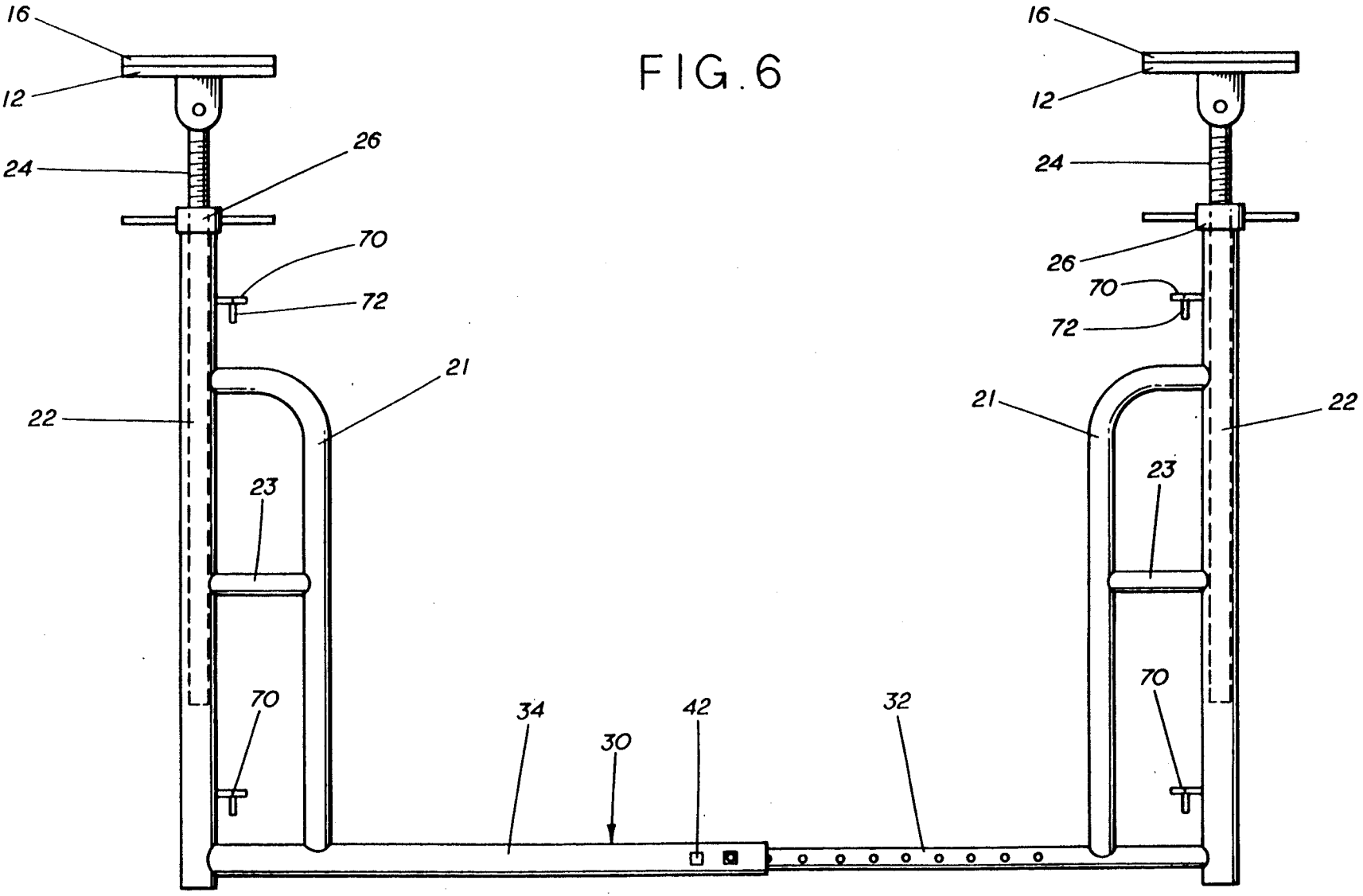
FIG. 6 is a detailed front view of the fore and aft keel stand frame members also having the adjustable frame width feature of the invention.

To accommodate boats of varying hull widths, the transverse braces are constructed to provide for adjusting their overall length. Although any length adjusting mechanism can be used to provide a rigid transverse brace of adjustable length, the most simple arrangement is shown in FIGS. 1, 2, and 6—the keeled boat stand. With reference to FIG. 4, the transverse braces 30 are constructed of two half braces 32 and 34, of tubular steel, and sized to fit together in telescoping arrangement. Each of the half braces 32 and 34 is provided with a series of spaced holes 38 so that when the braces 32 and 34 are fitted together they can be locked at a predetermined length by inserting a suitable pin type fastener, such as a nut and bolt 42, flip lock pin, or similar fastener. This pair of struts connected by adjustable half braces permits the fore and aft frame members to be assembled from two basic preassembled parts or frame halves which can be assembled on-site by merely connecting the frame parts by inserting the fastener 42 in the predrilled receiving holes 38.

Because keeled boats require struts of considerable length to elevate both the hull and keel above ground, as shown in FIG. 2, the keeled boat fore and aft frames include an additional transverse brace 30' to provide bracing nearer the top of the strut 22. Ample fore and aft frame rigidity is achieved in the keeled boat stand of FIG. 2, having two transverse braces, when the lowermost transverse brace 30 is attached at some distance, preferably an inch or more, above the bottom end of the strut and the uppermost transverse brace 30' is about one quarter the length of the strut 22 from its upper end.

An alternative half brace configuration is illustrated in FIG. 1 and 5. Although illustrated in the context of a keeled boat frame, it is equally suitable for either the keelless boat frame or the keel frame illustrated on FIG. 6 and discussed below.

With reference to FIG. 5, the half braces 32 and 34 are tubular members, preferably steel, each having a plurality of spaced holes 38 for receiving the pin type fastener 42. Instead of the telescoping arrangement, sleeve 36, having correspondingly spaced holes 40, is provided to receive the free ends of the two half braces 32 and 34. As can be appreciated, with this arrangement, the half braces 32 and 34 together with the sleeve 36 permit the struts 22 to be spaced as close together as the length of the half braces and as far apart as length and rigidity of the sleeve 36 will permit. The tube, sleeve and pin arrangement together with welding the tube ends to the struts provides for great structural rigidity of the fore and aft frame members, as well as simple assembly procedure. This half brace and sleeve configuration permits the boat stand fore and aft frames to include three basic preassembled parts to be shipped for on-site assembly by merely connecting the sleeve section to opposing frame end sections by way of the fastener 42.

Keelless Boat Support

For additional hull support, the keelless boat stand configuration shown in FIG. 1 permits an optional third strut 50 to be mounted on the sleeve 36. With reference to FIG. 5, the third strut 50 is provided with bracing arms 52 which fit into slots 53 in the strut 50 and into slots 54 in the sleeve 54 to provide structural support for the strut 50. In the preferred embodiment, the bracing arms are preassembled and welded to the strut So and the sleeve 36. The strut 50 is further provided with a slot 56 for receiving the sleeve 36 so that the strut 50 is firmly supported in its vertical orientation, and again is preferably preassembled and welded in place.

As can be appreciated, with reference to FIG. 5, this arrangement permits the intermediate strut 50 to be centered relative to the corner struts 22, or placed off center, by simply varying the location of the sleeve 36 relative to the half braces 32 and 34 during the on-site assembly of the boat stand.

As can now be appreciated, any mechanical arrangement which provides structurally rigid fore and aft frame members can be used to provide the frame width adjustment feature of the invention. For example, the half braces could be any cross section which would permit them to be joined at their free ends in telescoping relationship by any suitable clamping mechanism. In addition, the half braces could be joined to the struts by suitable clamps in lieu of welding. Moreover, for small keeled or keelless boats, the frame embodiment of FIG. 5 can be used without the optional intermediate strut 50, or the embodiment of FIG. 2 used without the upper 30'.

Keel Supporting Stand Frame

A separate keel frame as shown in FIG. 6 may also be provided for additional support about a tall or heavy keeled boat. This keel frame may include struts 22' having pads 12' mounted thereon and connected by transverse brace member 30'. In the preferred embodiment of the keel frame, a vertical brace member 21 is welded alongside the strut 22' with an additional brace 23 between the brace member 21 and the strut 22'. Front and back keel frames are connected to provide a stand by way of pins 70 for mounting cross braces 60. Assembly and construction of the cross braces with the keel frames is identical with their assembly and construction with the fore and aft frames, which is discussed in detail below. The keel frame of the present invention permits access to the entire keel for repairs, and in practice has been found to provide adequate midship support for keeled boats up to forty feet in length, when used in conjunction with the outer hull supporting stand assembly shown in FIG. 2.

Cross Braces Connecting Frame Members

Assembling both keeled and keelless shoring systems is completed by connecting the fore and aft frame members of either FIGS. 4 or 5 by way of cross braces 60, shown in FIGS. 1 and 2. The keel stand of FIG. 6 is similarly completely assembled by joining the two frames illustrated in FIG. 6 with the cross braces 60.

With reference to FIGS. 1 and 2, the cross braces 60 each include two cross brace rods 62 and 64 which are pivotally attached to each other at their approximate midpoints 66. The cross braces are preferably constructed of extruded steel having a U-shaped or V-shaped cross section to enhance rigidity. The cross section of a U-shaped or V-shaped rod may be pressed flat in the region of the pivot point 66 of each rod to ease pivoting. In the preferred embodiment of the invention, holes 68 are formed at the ends of each rod to receive cross brace mounting pins 70 which extend from the struts 22. Each vin 70 is preferably provided with a gravity lock 72 so that, after insertion in the cross brace holes 68, it drops to secure the cross braces on the pins. Alternatively, the pins could be threaded and used in conjunction with a nut to secure the rods to the frames, or any conventional flip lock device could be used.

With this cross bracing arrangement, the cross brace rods 62 and 64, joined at their centers by the pivot 66, can be easily mounted to the corner struts 22 or 22' or 22'' to provide rigid cross braces for the shoring assembly. The pivot 66 permits the cross brace 60 to accommodate approximately a foot of variation in the spacing between the frames to be connected.

Multiple Frame Adaptability

As can now be appreciated, the invention is not limited to a single pair of fore and aft frames, but can include additional frames connected by cross braces to provide support for long boat hulls. For example, a 35 foot keelless boat may require one frame toward the bow, one amidship, and one toward the stern. The three frames are stabilized by a first pair of cross braces connecting the bow and midship frames and a second pair of cross braces connecting the midship and stern frames. To permit multiple frames to be joined in series along a boat hull, the cross brace mounting pins 70 should be long enough to accommodate two cross brace rods in abutting relationship.

Ground Variation Adaptability

By attaching the lowermost transverse brace 30 a distance above the bottom end of fixed struts 22 in all of the frame embodiments, allowance is made for uneven ground surfaces. Thus, as can be seen in FIG. 5, each frame will have only two points of contact with the ground. The strut bases are generally broad enough as contact points ground for most ground surfaces without the need for surface contacting blocks. However, as practiced, optional base plates are provided for use with the shoring system in situations of particularly soft ground surfaces.

Hull Size Adaptability

As practiced, the shoring system of the present invention includes frame assemblies in three basic sizes, one to provide a frame width adjustable from four to six feet, one from six to eight feet, and one from eight to ten feet. Cross brace assemblies are provided in lengths from 7 feet to 18 feet, in one foot increments. The shoring assemblies for both keeled and keelless boats can accommodate boats up to at least forty feet in length.

Stand Assembly Mobility

The stand of the present invention includes the additional advantage of being moveable even with a boat mounted on the assembled stand. With the lowermost transverse braces 30 located above the base of the struts 20, a dolly can be inserted beneath the braces 30, and used to raise the entire structure so that the struts 20 are slightly above ground. The stand and its mounted boat hull can then be moved, being securely supported by the transverse braces 30 during transport.

Variations

As can now be appreciated, various modifications in structural connections of the various frame parts and struts, only some of which are noted above, can be made without departing from the spirit of the invention, the scope of which is defined by the claims which follow.

What is claimed is:

1. A boat stand assembly comprising:

front and back rectangular, rigid, unitary frame portions, each portion consisting of a pair of vertical struts for providing the sole vertical support, each vertical strut mounting a pad, and each vertical strut being unsupported by any oblique bracking, and a pair of horizontal struts welded at right angles to the vertical struts for providing the sole lateral support to the vertical struts and for rigidly connecting the vertical struts in fixed spaced relationship to one another such that the vertical struts and the horizontal struts provide a rigid, unitary frame portion; and a pair of cross braces for connecting the front and back frame portions in fixed, spaced relationship to one another to form a complete, self-supporting boat stand.

2. The assembly of claim 1 further comprising means for adjusting the height of the strut-mounted pad relative to the ground.

3. The assembly of claim 1 wherein at least one of the front and back frame portions further includes an intermediate strut mounted on the transverse brace members, wherein the intermediate strut mounts a hull contacting pad.

4. The assembly of claim I wherein at least one of the frame portions includes means for adjusting the length of said elongated brace members to different lengths for altering the spacing between the pair of struts.

5. The assembly of claim 4 wherein the elongated brace members length adjusting means comprises two half braces joined by a sleeve and further comprises an intermediate strut mounted on the sleeve.

6. The assembly of claim 4 wherein the transverse brace members adjusting means comprises two half braces, each provided with a plurality of spaced holes so that the half braces may be joined by way of a fastener inserted through matching holes in the half braces.

7. The assembly of claim 2 wherein the pad height adjusting means includes a screw jack.

8. The assembly of claim 7 further comprising means for adjusting the pad orientation relative to ground.

9. The assembly of claim 8 wherein the pad orientation adjusting means includes a universal joint connecting the pad to the strut and means for securing the pad in a predetermined orientation.

10. The assembly of claim 1 wherein the cross braces include at least two brace members pivotally joined adjacent their midpoints and wherein the cross braces are connectable to the frame portions by way of pins extending from the struts which are sized to fit within holes adjacent the distal ends of the cross brace members.

11. A boat stand assembly with keel support, the boat stand for supporting a boat above a surface, comprising:

front and back rigid, unitary frame portions, each portion consisting of a pair of vertical struts for providing vertical support, each vertical strut mounting a pad, a pair of vertical brace members, one alongside each vertical strut, and each rigidly welded to the vertical strut that it is alongside, and a single horizontal strut welded at right angles to the pair of vertical brace members for rigidly connecting the vertical struts, vertical brace members, and horizontal strut in fixed spaced relationship to one another such that the vertical struts, vertical brace members, and horizontal strut provide a rigid, unitary frame portion, a center vertical strut mounting a pad, said center vertical strut welded at a lower end away from the surface of the center of said horizontal strut so that said horizontal strut supports said center vertical strut away from the surface, and a pair of cross braces for connecting the pair of frame portions in fixed, spaced relationship to one another.

12. The boat keel stand assembly of claim 11 wherein the cross braces connect the pair of frame members by way of pins extending from the struts for insertion in corresponding holes in the distal ends of the cross braces and wherein the cross braces include at least two brace members pivotally connected near their midpoints.

13. The assembly of claim 10, wherein said pins are gravity lock pins.

14. The assembly of claim 10, wherein said pins are flip lock fasteners.

15. The assembly of claim 10, wherein said pins are threaded for use with nuts.

16. The assembly of claim 1, wherein the transverse brace members are rigidly connected to the struts by welds.

17. The assembly of claim 11, wherein the transverse brace members are rigidly connected to the struts by welding and the vertical brace members are rigidly connected to the transverse brace member and the struts by welds.

18. The assembly of claim 12, wherein said pins are gravity lock pins.

19. The assembly of claim 12, wherein said pins are flip lock fasteners.

20. The assembly of claim 12, wherein said pins are threaded for use with nuts.

21. A boat stand assembly comprising:

front and back rectangular, rigid, unitary frame portions, each portion consisting of a pair of vertical struts for providing the sole vertical support, each vertical strut mounting a pad, and each vertical strut being unsupported by any diagonal bracing, and means for maintaining the vertical struts in fixed, spaced relationship with one another and providing stability to said vertical struts, said means welded to said vertical struts; and a pair of cross braces for connecting the front and back frame portions in fixed, spaced relationship to one another to form a complete, self-supporting boat stand.

* * * * *